US005355104A

United States Patent [19]

Wolfson et al.

[11] Patent Number: 5,355,104

[45] Date of Patent: Oct. 11, 1994

[54] PHASE SHIFT DEVICE USING VOLTAGE-CONTROLLABLE DIELECTRICS

[75] Inventors: Ronald I. Wolfson, Los Angeles; Clifton Quan, Arcadia; Donald R. Rohweller, Torrance, all of Calif.

[73] Assignee: Hughes Aircraft Company, Los Angeles, Calif.

[21] Appl. No.: 10,943

[22] Filed: Jan. 29, 1993

[51] Int. Cl.[5] ..... H01P 1/18; H01P 3/08

[52] U.S. Cl. ..... 333/161; 333/26; 333/139

[58] Field of Search ..... 333/156, 140, 158, 161, 333/33, 34, 116, 138

[56] References Cited

U.S. PATENT DOCUMENTS

| | | | |
|---|---|---|---|
| 3,448,410 | 6/1969 | Parks | 333/161 |
| 4,375,054 | 2/1983 | Pavio | 333/238 X |
| 5,032,805 | 7/1991 | Elmer et al. | 333/156 |
| 5,075,646 | 12/1991 | Morse | 333/161 X |
| 5,212,463 | 5/1993 | Babbitt et al. | 333/161 |

OTHER PUBLICATIONS

Cohn, "Shielded Coupled-Strip Transmission Line", IEEE Trans. Microwave Theory Tech., MTT-3, pp. 29-38, Oct. 1955.

"A Broad-Band E-Plane 180° Millimeter-Wave Balun (Transition)," R. W. Alm et al., IEEE Microwave and Guide Wave Letters, vol. 2, No. 11, Nov. 1992, pp. 425-427.

*Primary Examiner*—Seungsook Ham

*Attorney, Agent, or Firm*—L. A. Alkov; W. K. Denson-Low

[57] ABSTRACT

A length of strip transmission line uses two symmetrically spaced center conductors between two groundplanes. These conductive strips produce an even-mode electric field between the two groundplanes when excited in-phase and an odd-mode electric field when excited in anti-phase relationship. For the latter case, the phase velocity of the odd-mode is significantly affected by the electric field in the gap region between the conducting strips. By varying the relative dielectric constant of a material located in the gap region, e.g., by means of a voltage-controllable dielectric such as barium-titanate compositions, the phase velocity and, hence, the phase shift of an RF signal propagating through the strip transmission medium can be controlled.

14 Claims, 5 Drawing Sheets

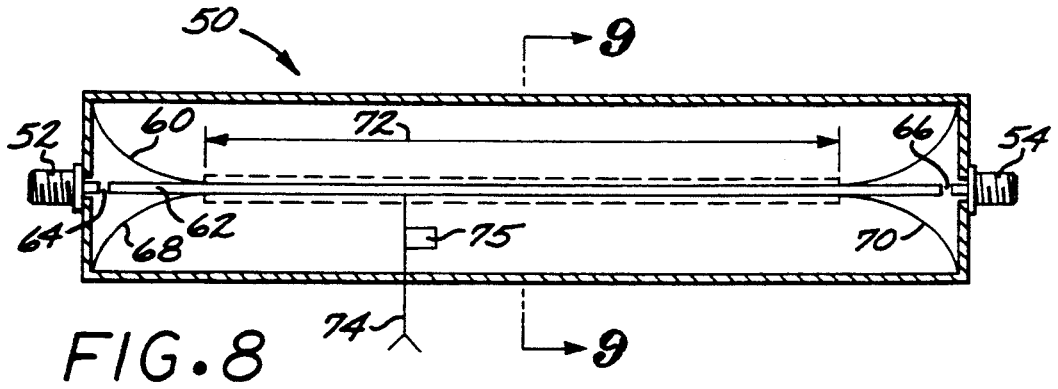
FIG. 8
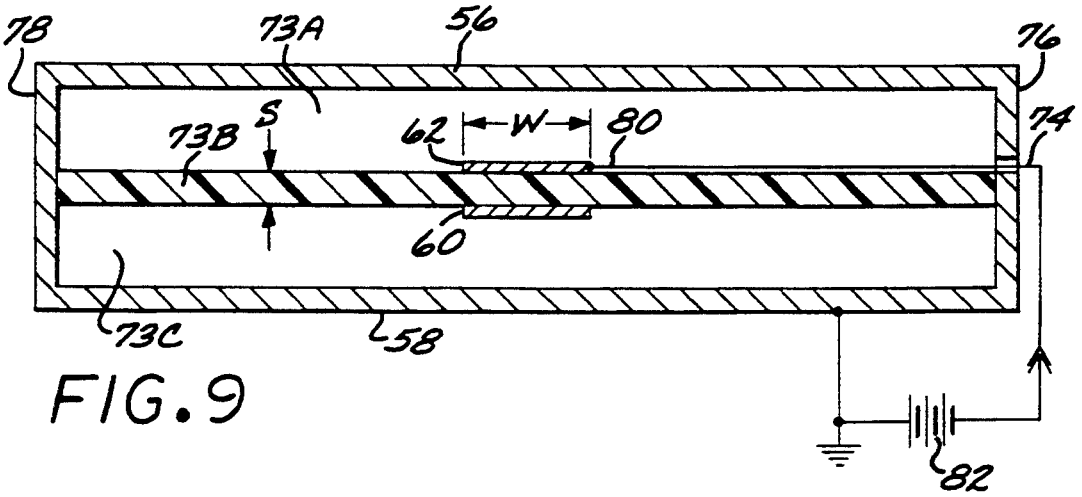
FIG. 9
FIG. 10
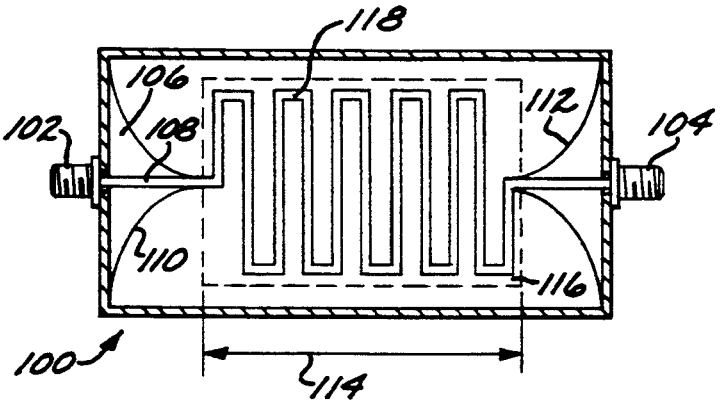

PHASE SHIFT DEVICE USING VOLTAGE-CONTROLLABLE DIELECTRICS

BACKGROUND OF THE INVENTION

The present invention relates to RF phase shift devices, and more particularly to a device capable of producing a continuous, reciprocal, differential RF phase shift with a single control voltage.

Conventional phase shifters use either ferrites or PIN diodes to switch the phase characteristics of a transmission line. While recent developments in miniaturized, dual-toroid, ferrite phase shifters have allowed their integration into microstrip circuits to achieve reciprocal operation, PIN-diode phase shifters are still widely used. Depending on the particular application requirements, the digital phase bits are traditionally configured from one of the following circuit types: 1) switched line; 2) loaded line; 3) reflective (e.g., hybrid coupled); or 4) high-pass/low-pass filter.

A number of these circuits are typically connected in series to form a device that provides 360 degrees of differential phase shift. Circuit losses, along with parasitic elements of the PIN diodes and the bias networks required, increase the RF insertion loss above that of an equivalent, straight through, transmission line. Phase setting accuracy is limited to one-half of the smallest phase bit increment and results in phase quantization sidelobes that may be objectionable. Average power-handling capability is primarily limited by the maximum allowable temperature rise due to RF losses concentrated in the diode junction area. Cost, size, weight and reliability of the driver circuits and associated power supplies become important issues, as each phase bit requires a separate driver and control power for the PIN diodes can be substantial in a large array.

It is therefore an object of the present invention to provide an RF phase shift device that produces a continuous, reciprocal, differential RF phase shift with a single control voltage.

SUMMARY OF THE INVENTION

In accordance with the invention, an RF phase shifter includes first and second spaced groundplanes and first and second spaced conductors disposed between the groundplanes. The conductors are separated by a gap in which a dielectric material is disposed. The dielectric material is characterized by a variable relative dielectric constant, which may be modulated by application of dc electric field.

The device includes means for applying a variable electric field to the dielectric material to set the dielectric constant at a desired value in order to provide a desired phase delay through the device. When the conductors are excited in phase, the dielectric constant of the dielectric has only negligible effect on the propagation velocity of the RF signal; however, when the conductors are excited in anti-phase relationship, the effect is substantial.

The means for applying an electric field comprises first and second electrodes, the dielectric material being disposed between the electrodes, and the means for applying a variable electric field across the dielectric material includes a means for applying a voltage across the electrodes. Preferably the electrodes are the first and second conductors.

In one preferred form, the groundplanes, the conductors and the dielectric material comprise a suspended stripline transmission line. The first and second conductors can be arranged in either a coplanar, edge-coupled relationship or in a parallel, width-coupled relationship.

In accordance with another aspect of the invention, the device can be configured in a true-time-delay device that provides large differential time delays, where the time delay is variable, in dependence on the magnitude of the electric field across the dielectric material.

BRIEF DESCRIPTION OF THE DRAWINGS

These and other features and advantages of the present invention will become more apparent from the following detailed description of an exemplary embodiment thereof, as illustrated in the accompanying drawings, in which:

FIGS. 8 and 9 are respective plan and cross-sectional views of an RF phase shifter embodying the present invention.

FIG. 10 shows a true-time-delay device embodying the present invention.

DETAILED DESCRIPTION OF THE PREFERRED EMBODIMENT

Overview of the Invention

Voltage-controlled dielectrics offer an attractive alternative to traditional solid-state and ferrite phase-shift devices for the design of electronically scanned array antennas. Either liquid crystals, or ferroelectric materials which operate in either the ferroelectric or paraelectric domain, can provide the desired change in dielectric constant with an applied dc electric field. A large class of such ferroelectric materials exists: $BaSrTiO_3$ (BST), $MgCaTiO_3$(MCT), $ZnSnTiO_3$(ZST) and BaOPbO-$Nd_2O_3$-$TiO_3$ (BPNT), to name just a few. Recently developed sol-gel processes make it feasible to engineer high-purity compositions with special microwave characteristics. BST has received the most attention, with properties that include voltage-controlled dielectric constant tunable over a 2:1 ratio, relative dielectric constant ranging from about 20 to over 3,000 and moderate microwave loss tangent from 0.001 to 0.050.

Figure 1:
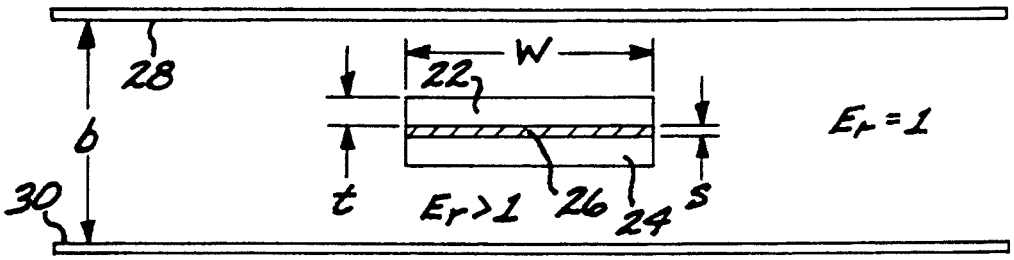
FIGS. 1 and 2 are cross-sectional illustrations of an RF phase shifter in accordance with this invention employing respectively width-coupled and edge-coupled lines constructed in air-dielectric suspended stripline.
Figure 2:
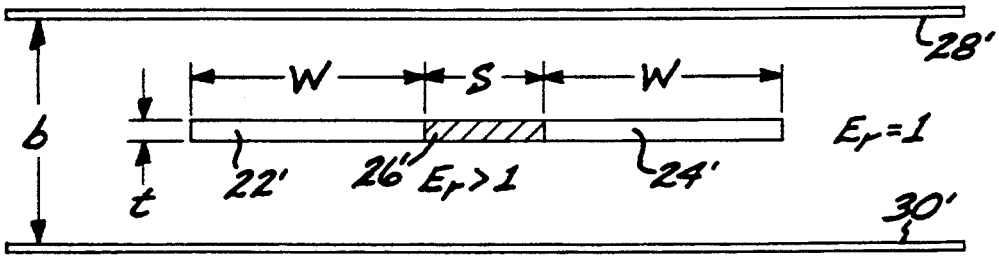

FIGS. 1 and 2 illustrates two configurations for implementing the invention in air-dielectric suspended stripline. Coupled conductive strips separated by a voltage-controllable dielectric are centered between groundplanes. FIG. 1 illustrates width-coupled lines. Conductive strips 22 and 24 of width w and thickness t are separated by a voltage-controllable dielectric 26 of width s. The dielectric constant $\epsilon_r$ of the dielectric 26 exceeds 1.

FIG. 2 illustrates edge-coupled lines. Conductive strips 22' and 24' of width w and thickness t are centered between the groundplanes 28' and 30', and are separated by a voltage-controllable dielectric 26' of width s.

Figure 3:
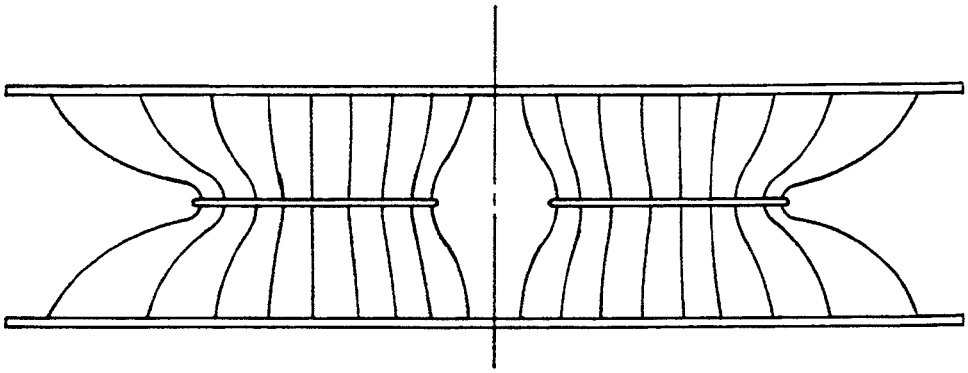
FIGS. 3 and 4 illustrate electric field lines of the device of FIG. 2 when excited in phase and in anti-phase relationship, respectively.
Figure 4:
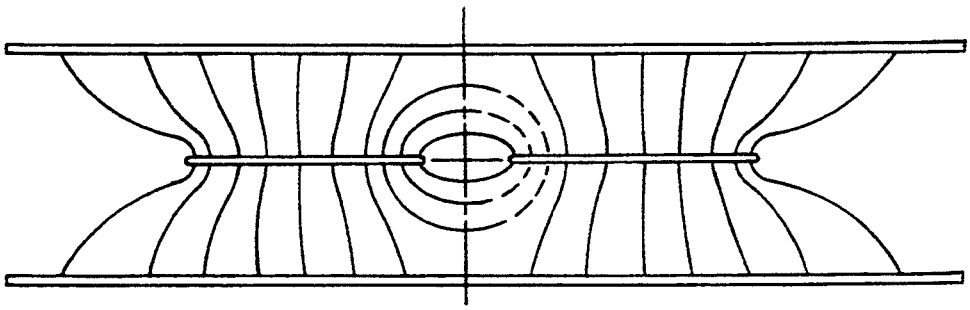

The coupled strips 22 and 24 of the width-coupled case, as well as the coupled strips 22' and 24' of the edge-coupled case, produce an even-mode electric field when excited in phase (FIG. 3) and an odd-mode electric field when excited in anti-phase relationship (FIG. 4). The phase velocity of the even mode is essentially unaffected by the dielectric 26 or 26' because little or no electric field exists in the gap between the conductive strips. The phase velocity of the odd mode, however, is significantly affected by the large electric field within the dielectric. Thus, by varying the relative dielectric constant in the gap region, phase velocity and hence phase shift of an RF signal propagating through the transmission medium can be modulated. The same basic principles can also be applied to solid-dielectric stripline or to microstrip transmission lines.

Normally, both strip are fed in-phase as a consequence of the symmetry of the microwave structure. The odd-mode, which is usually undesirable, can be introduced by some type of asymmetry, e.g., geometric, or an unbalance in amplitude or phase. Typically, both even and odd modes coexist in proportion to the degree of unbalance that exists. The invention operates most effectively when the odd mode predominates. A microstrip-to-balanced-stripline transition is actually a balun that introduces a 180 degree phase shift between the width-coupled strips and forces the odd mode to propagate. A type of 180 degree balun for edge-coupled strips is described by R. W. Alm et al., "A Broad-Band E-Plane 180° Millimeter-Wave Balun (Transition), " IEEE Microwave and Guide Wave Letters, Vol. 2, No. 11, November 1992, pages 425–427. As those strips are fed from opposite walls of the input waveguide, a 180 degree phase reversal occurs.

It has been shown that those ferroelectric materials with the largest microwave electro-optic coefficients also have the largest dielectric constants, e.g., $Ba_{1-x}Sr_xTiO_3$. The major challenge in developing these materials for microwave applications is reduction of absorption losses, which have both intrinsic and extrinsic contributions. The intrinsic contribution is due to lattice absorption, whereas the extrinsic contribution is due to anion impurities, cation impurities and domain wall motion. The solution-gelatin (sol-gel) process can produce materials with lower RF losses by reducing their orientational dependence through randomization. Furthermore, as the sol-gel process does not require the high-temperature processing normally associated with ceramics, contamination by impurities can be more carefully controlled.

The key electrical properties of dielectric materials for phase shifter applications are $\epsilon_r$, the relative dielectric constant; $\Delta\epsilon_r$, the change in relative dielectric constant that can be obtained with an applied electric field; and tan $\delta$, the microwave loss tangent.

The range of relative dielectric constants selected for BST is well below the maximum specified value of about 3,000. The rationale for using materials with lower relative dielectric constants is that the odd-mode coupled stripline circuit described above performs well with values of dielectrics in this range; materials with lower $\epsilon_r$ will have lower than $\delta$; and it is easier to formulate low-dieelectric-constant materials that are stable over a wide temperature.

Ferroelectric materials are characterized by a spontaneous polarization that appears as the sample is cooled through a phase transition temperature known as the Curie temperature, $T_c$. The relative dielectric constant of such a material exhibits a sharp maximum near $T=T_c$, caused in most materials by the condensation of a temperature-dependent or "soft" lattice vibration mode. As the sample temperature reaches $T_c$, the long- and short-range forces acting on individual ions in the lattice become nearly balanced, resulting in large amplitudes and diminished vibration frequency of the mode. In this temperature range, linear restoring forces on the ions in the lattice become very small and applied electric fields can induce significant linear and non-linear electro-optic coefficients at microwave frequencies.

Figure 5:
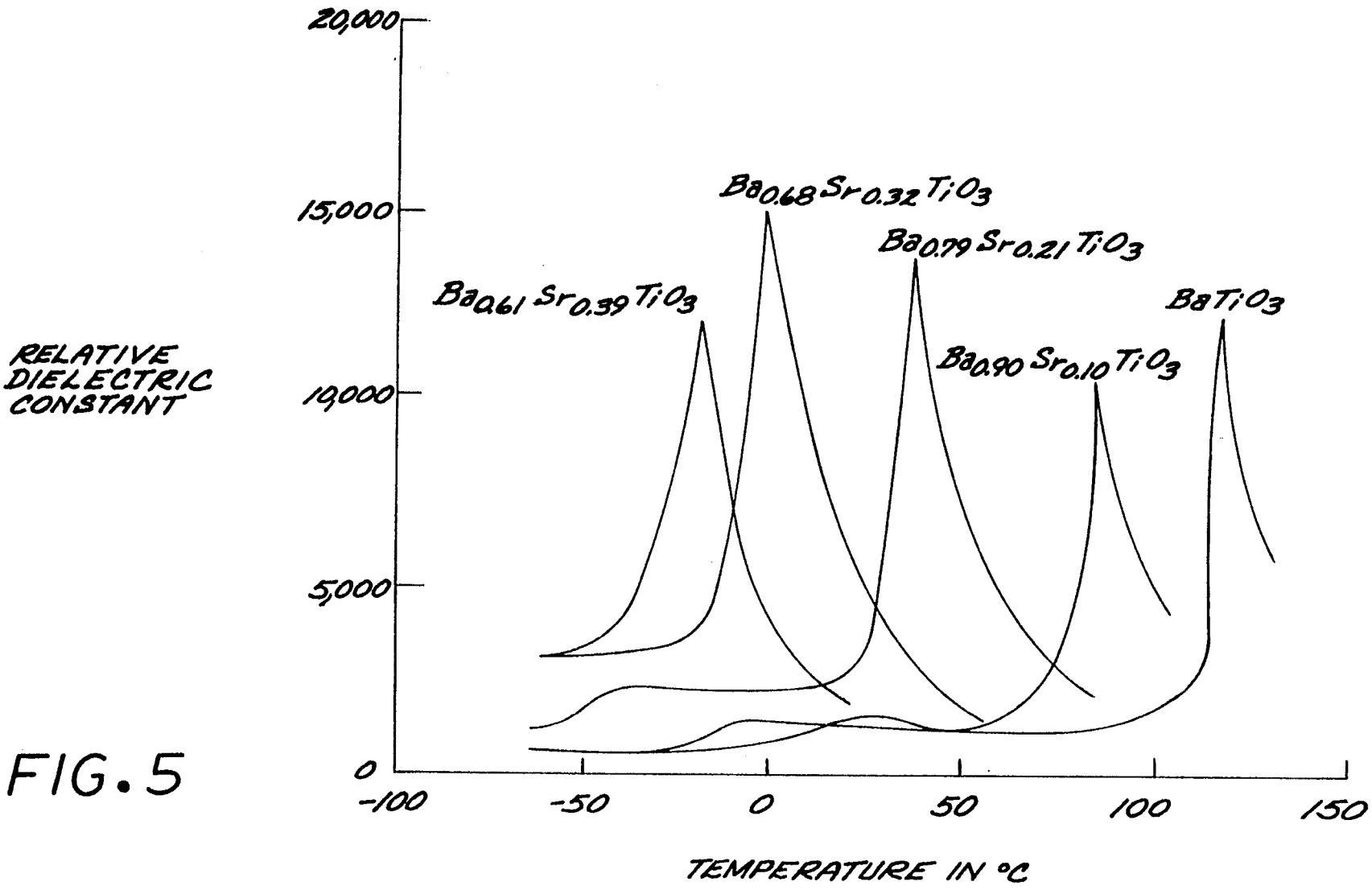
FIG. 5 is a graph illustrating the relative dielectric constant of compositional mixtures of $Ba_{1-x}Sr_xTiO_3$ as a function of temperature.

The major difficulty in working with ferroelectric materials at or near the Curie temperature in order to achieve large changes in relative dielectric constant with applied voltage is that because of the sharp maximum, the material is extremely temperature sensitive. This is illustrated in FIG. 5 for compositional mixtures of $Ba_{1-x}Sr_xTiO_3$, where increasing proportion of $SrTiO_3$ has been introduced to reduce the Curie temperature below that of pure $BaTiO_3$, about 120° C. Note that for the material compositions shown, the relative dielectric constant changes by about 2:1 over a temperature range of 20° C.

Figure 6:
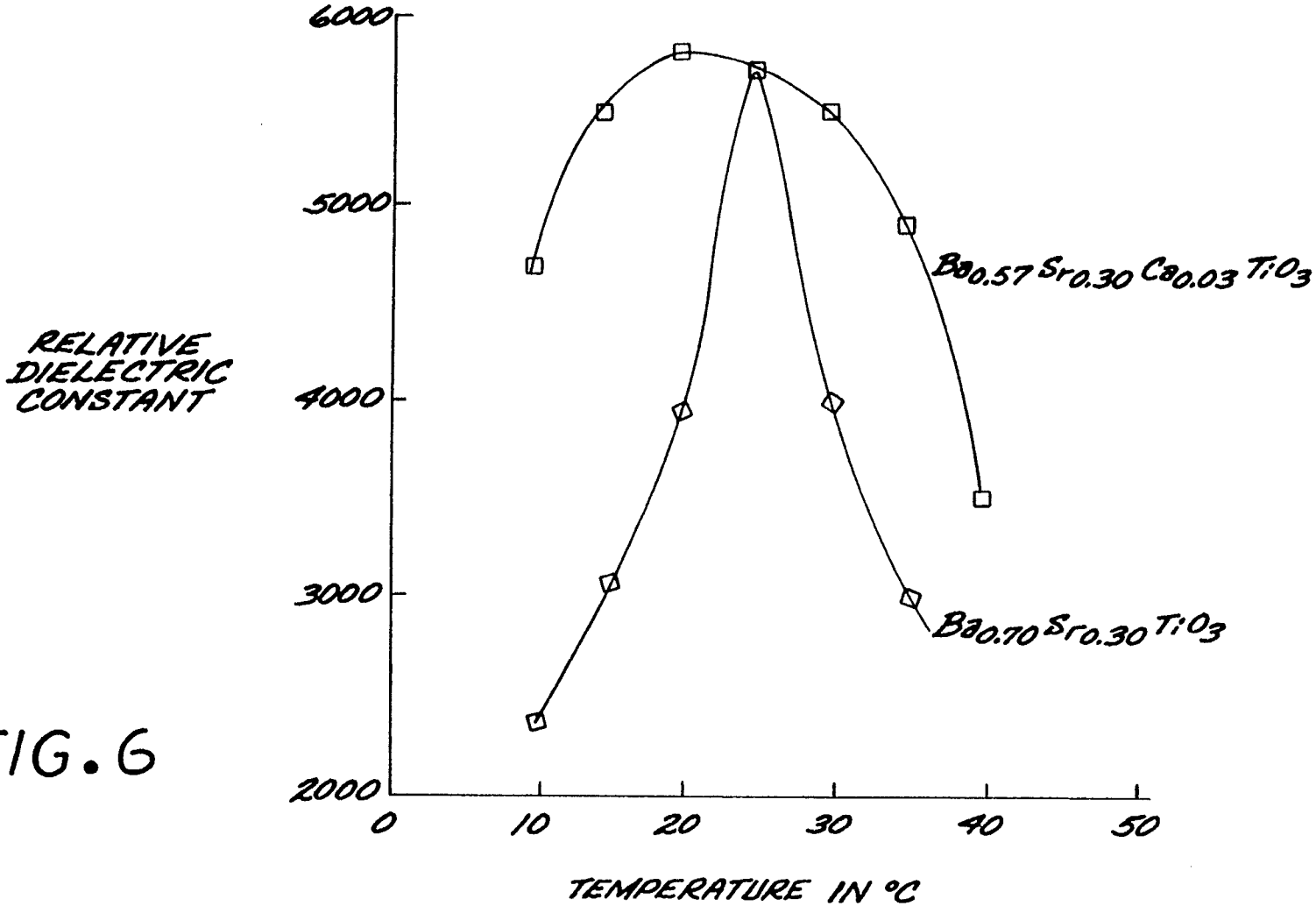
FIG. 6 is a graph showing that a calcium dopant reduces the dielectric constant peak that occurs at the Curie temperature and broadens the usable temperature range of BST.

The addition of certain dopants, e.g., calcium, broadens the usable temperature range, as shown in FIG. 6.

Figure 7:
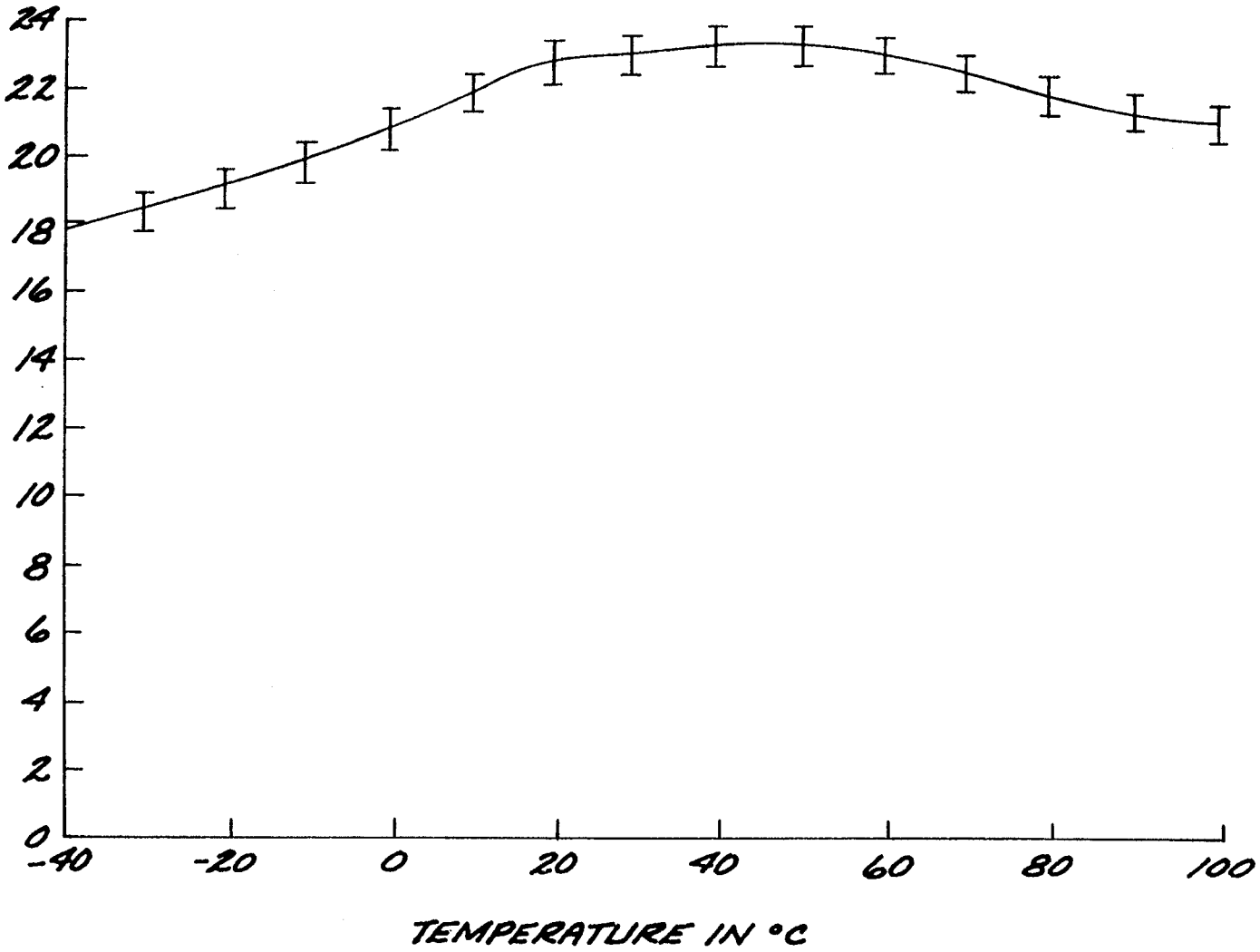
FIG. 7 is a graph illustrating that the variation of the relative dielectric constant of porous BST is a broad function of temperature without the sharp peaks that occur in the high-density BST compositions.

Further temperature stabilization of the BST is achieved when the dielectric constant is reduced, either by porosity or dilution in a low-loss dielectric polymer. FIG. 7 shows the variation in relative dielectric constant for a sample of porous BST that was measured over the temperature range of −40° C. to +100° C.

Modeling of non-linear materials such as BST compositions becomes more difficult when porosity is increased in order to reduce the relative dielectric constant. Other factors that complicate the analysis are the change in dielectric constant with applied electric field and effects due to the shift in Curie temperature. The sol-gel processing technique, however, can dramatically improve the microstructure of the material with a consequent reduction in the microwave loss tangent.

A ferroelectric phase shifter in accordance with this invention works on the principle that the relative dielectric constant of a ferroelectric material is controlled by an externally applied dc electric field, which in turn changes the propagation constant of a transmission line. The dc bias is applied by means of a pair of electrodes, generally parallel to one another, with the ferroelectric material in between. The bias electrodes can either be an integral part of the RF transmission circuit, or implemented especially to provide the bias function. It is generally preferable to avoid separate electrodes, as they must be carefully arranged so as not to interfere with the RF fields; otherwise, interactions can produce large internal reflections, moding or excessive insertion loss of the RF signal. Certain RF transmission structures, such as coaxial lines, parallel-plate waveguides and coupled-strip transmission lines have existing conductors that can be used as bias electrodes.

There are several other considerations when implementing dc bias in the transmission structures. First, a dc block is required to prevent the dc bias voltage from shorting out or damaging sensitive electronic circuits, such as amplifiers or diode detectors. The dc block can be a small gap in the transmission line or a high-pass filter that couples through the RF but open-circuits the dc. Second, a bias port must be provided for introducing the dc bias without allowing RF leakage. This is generally accomplished by means of a high-impedance inductive line or a low-pass filter. The bias line should generally be located orthogonal to the RF electric field in order to minimize coupling and prevent shorting out the latter.

For experimental hardware, it is often convenient to use a commercially available monitor tee/dc block in order to eliminate the bias port design effort. Such components are readily available, e.g., from MA-COM-/Omni-Spectra, as part numbers 2047-6010 through 2047-6022. For production hardware, an integral bias port design is preferred to reduce size, weight, insertion loss and cost.

DESCRIPTION OF PREFERRED EMBODIMENTS

FIGS. 8 and 9 show an analog phase shifter 50 based on the even-mode/odd-mode principle described above. The coaxial input and output connectors 52 and 54 at either end of the unit 50 transition into a conventional, unbalanced, microstrip transmission line that is suspended between two groundplanes 56 and 58. The metallization that forms the suspended microstrip groundplane at either connector tapers down in width to form a balanced, two-conductor stripline transmission line at the center of the device. The lower conductor 60 nominally forms the microstrip groundplane adjacent to the connectors 52 and 54, but as shown, tapers down in width to form, with the upper conductor 62, microstrip-to-balanced-stripline transitions 68 and 70. In general, the linewidths of the coaxial connector center conductor and the microstrip line will be different, requiring a transition, e.g., a taper or step-transformer for matching impedances. The lower conductor 60, and if necessary the upper conductor 62, transition to width w to provide the balanced stripline in the phase shift region 72.

Gaps 64 and 66 are formed in the upper conductor 62 as dc blocks in the RF line.

A voltage controllable dielectric 73B is disposed between the conductors 60 and 62 in the region 72. Preferably, the voltage controllable dielectric not only extends into the transitions from connector to connector, but also extends sideways beyond the upper and lower conductors 60 and 62. This configuration is preferred because: 1) the hardware will be easier to fabricate and assemble; 2) if the dielectric does not extend into the transition region, a hugh discontinuity is created that will require special matching; and 3) negligible RF fields exist in the high dielectric material except for the region that lies between the coupled lines. Extending the voltage controllable dielectric into the transition regions will contribute to the overall differential phase shift; however, most of the phase shift still occurs within the "phase shift region" because of the favorable anti-phase relationship there.

A bias port 74 is formed in sidewall 76 of device 50. A thin bias lead 80 runs through the bias port 74 and low-pass filter 75 to upper conductor 62, and connects to a dc bias source 82. The lower conductor 60 is dc grounded at the connectors 52 and 54. The source 82 provides a selectable dc bias between the conductors 60 and 62, thereby providing a means to apply a dc electric field across the dielectric 73B.

The length of the phase shift region 72 is selected 30 with the voltage range supplied by the source 82, to provide at least 360 degrees of phase shift at the lower frequency edge of the frequency band of interest; at higher frequencies the device will provide more than 360 degrees phase shift.

The microstrip-to-balanced-stripline transition serves as a balun that can be designed to produce an anti-phase condition between the two conductive strips over an operating band of an octave or more. The balun produces the anti-phase condition in the following manner. When an RF signal is applied to either coaxial connector 52 or 54, a current is caused to flow in the center conductor and attached microstrip line that lies above the suspended groundplane. This current produces an image current sheet that flows in the opposite direction, but which is spread across the width of the suspended groundplane. As the latter tapers down to match the width of the microstrip line above, the image current density increases until both currents are equal in magnitude and in anti-phase relationship. The even-mode and odd-mode impedances of the coupled lines can be determined from the physical parameters "b," "w," "s" and "$\epsilon_r$" using well-known relationships given in the paper by S. B. Cohn, "Shielded Coupled-Strip Transmission Line," IEEE Trans Microwave Theory Tech , MTT-3, pp. 29–38, Oct. 1955. The even-mode phase velocity in the phase shift region 72 will usually be on the order of only one percent less than the velocity in free space. The phase velocity of the odd mode, on the other hand, is much more noticeably affected by the dielectric 73B in the phase shift region 72. The ratio of phase velocities for the two modes is given by:

$$(V_{oo}/V_{oe})=(1+[2Z_{oo}Z_e/(377)^2]/4((1+[2\epsilon_r Z_{oo}Z_o/(377)^2]))^{\frac{1}{2}} \quad (1)$$

where $V_{oo}$ is the odd-mode velocity, $V_{oe}$ is the even-mode velocity, $\epsilon_r$ is the relative dielectric constant of the material in the gap region, and the relative dielectric constant of the air-stripline structure is taken equal to one.

The groundplanes 56 and 58 serve as a rigid housing both to enclose the dielectric-filled strip transmission lines and to support the RF input and output connectors. The two outer dielectric layers 73A and 73C are each made from high-purity alumina sheets metallized on both surfaces. The suspended microstrip groundplane 60 that tapers down to form the lower coupled-strip transmission line 64 is etched on the metallized topside of the bottom layer 73C using conventional photolithographic techniques. The 50-ohm microstrip and upper coupled-strip transmission line 62 is similarly etched on the bottom side of the top layer 73A. The middle layer 73B is an unmetallized ferroelectric dielectric sheet. When the three dielectric layers 73A, 73B and 73C are stacked between the metal groundplanes 56 and 58, the voltage-controllable dielectric 73B lies between the conducting strips 62 and 64 that form the microstrip and coupled-strip transmission lines. As these metallized conductors are not directly connected to one another, they are used as electrodes for introducing the control voltage across the variable dielectric sample.

The device 50 can be compensated for input- and output-port mismatch caused by changes in relative dielectric constant of the dielectric insert material 73B. This matching can be accomplished by several means. The traditional approach is to use either tapers or step transformers to effect an average match between the impedance extremes that are encountered with changes in the dielectric constant of the ferroelectric material 73B. The voltage-controllable material 73B could also be used to improve matching by varying the dielectric constant along the length of the matching sections. Variation of dielectric constant with position could be achieved in many ways: for example, the use of material with a graded dielectric constant or segments of material with different dielectric constant or control-voltage characteristics; tapering the transmission-line width or gap distance between conducting strips; or providing separate electrodes with individual bias-level control at different locations along the matching sections.

FIG. 10 shows a true-time-delay (TTD) device, similar in concept to the phase shifter described above, except that the balanced, two-conductor transmission line 118 in the time delay region 114 is made very long by folding it in the fashion of a meanderline. Thus, the device 100 includes a lower metallization layer 106 and an upper conductor 108. The layer 106 tapers down in width adjacent each coaxial connector 102 and 104 to form microstrip-to-balanced-stripline transitions 110 and 112. The top and bottom conductors 108 and 106 are of equal width in the time delay region. A dc bias circuit of similar construction to that employed for device 50 (FIGS. 8 and 9) may be also employed with the device 100 to set up a dc electric field of variable magnitude between the two conductors 106 and 108 and across the dielectric 116. By adjusting the magnitude of the electric field, the relative dielectric constant of the material 116 is also adjusted, thereby providing the capability of adjusting the time delay of RF signals traversing the region 114. The amount of time delay that can be achieved is limited only by the insertion loss that can be tolerated and the VSWR due to the multitude of sharp bends. The VSWR of very long delay lines can be improved either by the use of sinuous lines or by making the bends random instead of periodic.

Table I shows measured data taken at 1.0 GHz on a porous barium-strontium-titanate sample.

TABLE I

| Applied voltage (kV/cm) | $\epsilon_r$ | TANδ |
|---|---|---|
| 0 | 150 | 0.010 |
| 1 | 145 | 0.010 |
| 2 | 139 | 0.009 |
| 3 | 132 | 0.009 |
| 4 | 124 | 0.008 |
| 5 | 115 | 0.008 |
| 6 | 110 | 0.008 |
| 7 | 106 | 0.007 |
| 8 | 103 | 0.007 |
| 9 | 100 | 0.007 |
| 10 | 98 | 0.007 |

The invention provides a means for producing a continuous, reciprocal, differential RF phase shift by varying the dielectric properties of a material with a single control voltage. Key advantages of the invention include the following:

1. Reciprocal operation (no reset required between transmit and receive);

2. Wideband operation (contains no resonant circuits);

3. Precise phase-setting accuracy (provides analog control):

4. True time delay (no beam squint with frequency changes);

5. Moderate power-handling capability (power distributed over large area);

6. Low control power (high electric field with low leakage current);

7. High reliability (single, simple driver; bulk material device); and

8. Low cost (single, simple driver; few discrete components).

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An RF phase shift device, comprising:

first and second spaced groundplanes;

a conductive housing, said housing comprising said first and second groundplanes and first and second sidewalls extending generally perpendicularly to said groundplanes;

first and second spaced conductors disposed between said groundplanes, said conductors being separated by a gap;

a dielectric material disposed in said gap, said material characterized by a dielectric constant which varies in value when a voltage is applied to said dielectric material;

means for applying a control signal to said dielectric material to set the value of the dielectric constant at a predetermined value in order to provide a desired phase delay region through said device;

means for exciting said first and second conductors by an RF signal to provide an anti-phase signal in said phase delay region; and wherein said groundplanes, said conductors and said dielectric material comprise a suspended stripline transmission line in said region, and wherein said second conductor tapers to a greater width on each side of said region to form a microstrip groundplane of a microstrip-to-balanced stripline transition.

2. The device of claim 1 wherein said means for applying a control signal comprises means for applying a variable electric field across said first and second conductors, said dielectric material having the property that its dielectric constant is dependent upon the magnitude of said electric field.

3. The device of claim 1, wherein said first and second conductors are arranged in a parallel, width-coupled relationship.

4. The device of claim 1 wherein said device provides a 360 phase shift range.

5. The device of claim 1 wherein said dielectric material comprises a composition of $BaSrTiO_3$.

6. The device of claim 1 wherein said means for applying a control signal comprises means for applying a bias dc electric field across said dielectric material.

7. The device of claim 6 wherein said means for applying a bias dc electric field comprises means for applying a voltage between said first and second conductors.

8. The device of claim 7 wherein said dielectric material is disposed in said gap within a phase shifting region defined along a section of said first and second conductors, and said means for applying a voltage comprises a dc blocking gap defined in said first conductor on either side of said region, a variable voltage source, and means for electrically connecting said first and second conductors in said region to said voltage source.

9. The device of claim 8 wherein said electrically connecting means comprises a low pass filter means.

10. The device of claim 1 further comprising first and second coaxial connectors connected to said respective transitions.

11. A true-time-delay device for RF signals, comprising:

first and second spaced groundplanes;

a conductive housing, said housing comprising said first and second groundplanes and first and second sidewalls extending generally perpendicularly to said groundplanes;

first and second spaced conductors disposed between said groundplanes, said conductors separated by a gap;

dielectric material disposed in said gap along a time delay region extending along a section of said conductors, said material characterized by a variable relative dielectric constant;

means for applying a control signal to said dielectric material to set said dielectric constant at a desired value in order to provide a desired time delay to RF signals propagating along a transmission line defined by said conductors in said time delay region;

means for exciting said first and second conductors by said RF signals to provide an anti-phase signal in said time delay region;

wherein said groundplanes, said conductors and said dielectric material comprise a suspended stripline transmission line in said region, and wherein said second conductor tapers to a greater width on each side of said region to form a microstrip groundplane of a microstrip-to-balanced stripline transition.

12. The device of claim 11 wherein said first and second conductors are arranged in a parallel, width-coupled relationship.

13. The device of claim 11 wherein said dielectric material comprises a composition of BaSrTiO3.

14. The device of claim 11 wherein said means for applying a control signal comprises means for applying a variable electric field across said first and second conductors, said dielectric material having the property that its dielectric constant is dependent upon the magnitude of said electric field.

* * * * *